US005363791A

United States Patent [19]

Stallard, III

[11] Patent Number: 5,363,791

[45] Date of Patent: Nov. 15, 1994

[54] WEAPONS LAUNCH SYSTEM

[75] Inventor: Clinton W. Stallard, III, Hampton, Va.

[73] Assignee: Newport News Shipbuilding and Dry Dock Company, Newport News, Va.

[21] Appl. No.: 62,812

[22] Filed: May 11, 1993

[51] Int. Cl.[5] ..... B63G 8/28

[52] U.S. Cl. ..... 114/318; 114/320; 114/238

[58] Field of Search ..... 114/316–320, 114/238; 89/1.809, 1.81, 1.814, 1.817, 1.816

[56] References Cited

U.S. PATENT DOCUMENTS

| | | | |
|---|---|---|---|
| 261,662 | 7/1882 | Brotherhood . | |
| 943,605 | 12/1909 | D'Equevilley-Montjustin . | |
| 970,210 | 9/1910 | Fuller . | |
| 1,037,519 | 9/1912 | Peacock . | |
| 1,985,184 | 12/1934 | Methlin . | |
| 2,390,635 | 12/1945 | Barker et al. | 114/238 |
| 2,426,610 | 9/1947 | Hopkins . | |
| 3,088,377 | 5/1963 | Siegel . | |
| 3,100,421 | 8/1963 | Moy | 114/238 X |
| 3,137,203 | 6/1964 | Brown . | |
| 3,180,222 | 4/1965 | Moy | 114/238 |
| 3,295,411 | 1/1967 | Lehmann . | |
| 3,301,132 | 1/1967 | Lehmann et al. . | |
| 3,499,364 | 3/1970 | D'Ooge . | |
| 3,969,977 | 7/1976 | Opdahl et al. | 89/1.81 |
| 4,033,225 | 7/1977 | Kartzmark, Jr. | 89/1.81 |
| 4,147,124 | 4/1979 | Brooks et al. | 114/321 |
| 4,523,538 | 6/1985 | Hollimann et al. | 114/238 |
| 4,848,210 | 7/1989 | Bissonnette | 89/1.81 |
| 5,050,523 | 9/1991 | Schwemin et al. | 114/259 |

*Primary Examiner*—Sherman Basinger
*Attorney, Agent, or Firm*—Lalos & Keegan

[57] ABSTRACT

A system for launching a weapon from a submarine comprises a tube for receiving the weapon, a ram assembly for launching the weapon, an actuator for actuating the ram assembly, and a volume within which water is received, the weight of the water received in the volume being approximately equal to the weight of the expended weapon. The ram assembly includes a ram head for transmitting a launching force to the weapon and a plurality of telescoping cylinders, the telescoping cylinders extending within the tube when the weapon is launched. The volume within which the water is received is formed between the tube and the telescoping cylinders in their extended position.

50 Claims, 3 Drawing Sheets

WEAPONS LAUNCH SYSTEM

BACKGROUND OF THE INVENTION

This invention relates to a system for launching a weapon from a submarine, and more particularly, for a high capability, low cost, lightweight weapons launch system for use in submarines.

Submarine weapons launch systems currently in use are complicated and require pumps, storage tanks, rams and high pressure air to fire the weapon. Structurally, these systems include a launch tube mounted internally to the submarine with a hatch, shutter or muzzle door covering the external surface. Thus, the hatch must be opened prior to weapon launch and closed after the weapon is launched. Additionally, the systems occupy a significant amount of space in the vessel interior, and thus the weapons capacity is limited by the available internal volume of the submarine.

Furthermore, current systems are often unable to accommodate aft-firing torpedoes due to insufficient room in modern submarines. The number of firing angles available is limited, thus compromising the vessel crew's ability to respond to a target by limiting the number of feasible firing solutions. Other undesirable features of the current launch systems include the need to trim the ship to compensate for the weight of the expended weapon and the lengthy reload time required between salvos.

In view of these and other limitations of the present weapons launch systems, the present invention has the following objects:

an improved system for launching weapons from a submarine;

an improved weapons launch system which eliminates the need for a hatch or other type of movable door on the external surface of the submarine;

an improved weapons launch system which, upon launch, automatically compensates for the weight of the expended weapon;

an improved weapons launch system which results in a low signature launch;

an improved weapons launch system which can be mounted externally to the submarine;

an improved, externally mounted, neutrally buoyant weapons launch system; and an improved weapons launch system utilizing a minimal amount of internal space.

Other objects and advantages of the present invention will become more apparent from the following description taken in conjunction with the accompanying drawings.

DETAILED DESCRIPTION OF THE PREFERRED EMBODIMENTS

Figure 1:
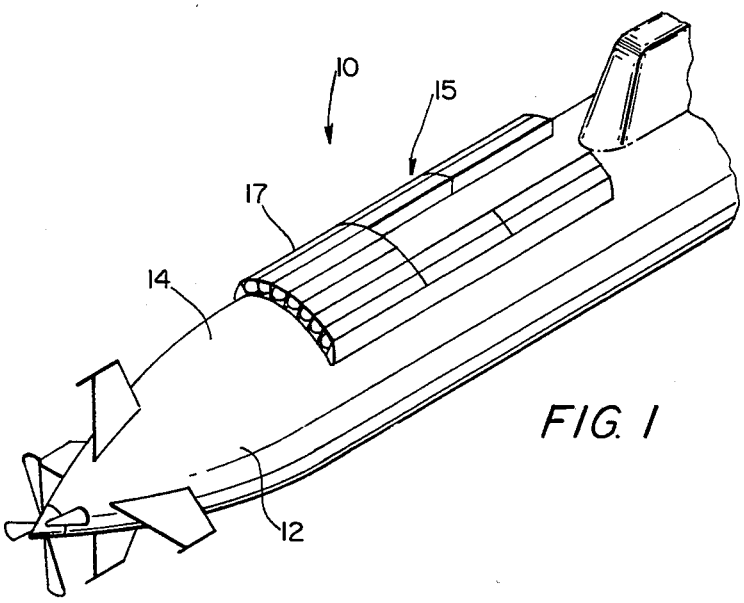
FIG. 1 is a partial perspective view of a submarine with a first embodiment of the launch system of the present invention.

Referring to the drawings, and more particularly to FIG. 1, a water vessel is shown generally as 10 and includes a hull 12 with an upper surface 14. Water vessel 10 is preferably a submarine, as is shown in FIG. 1.

Figure 2:
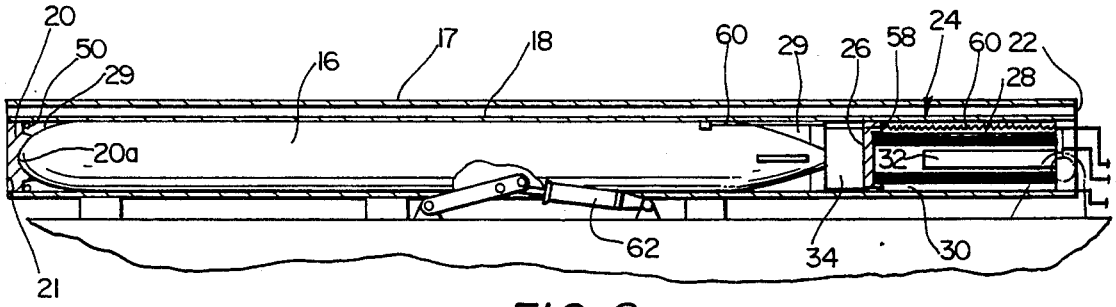
FIG. 2 is a cross-sectional side view of the launch system of FIG. 1 prior to weapon launch.

A weapons launch system 15 is shown in FIG. 1 externally mounted on upper surface 14 of hull 12. In the external configuration, a fairing 17 is preferably included to provide a faired surface for a group of weapons. As shown in FIG. 2, weapons launch system 15 generally includes a weapon 16, a launch tube 18, a disposable end cap 20 at the external end thereof and secured thereto by a latching means 21, and a launcher base 22 at the opposite end of the tube. End cap 20 is sealed to tube 18 by at least one O-ring 50 and includes a contoured surface **20*a* which contacts weapon 16 and holds the weapon in place within the tube. Disposed within tube 18 is a ram assembly 24 including a ram head 26 and a plurality of telescoping cylinders 28 shown in their stowed position in FIG. 2 and extending substantially the length of tube 18 in FIG. 3. Ram head 26 either abuts weapon 16 directly or contacts a disposable filler block 34, as is shown in FIG. 2. Thus, a weapons bay 29 is formed by tube 18, end cap 20, and ram head 26. Similarly, a ram assembly bay 30 is formed by tube 18, the ram head 26, and the launcher base 22**.

Ram assembly 24 is actuated by an ejecting means 32 disposed within ram assembly 24. When ram assembly 24 is actuated by the ejecting means 32, as described below, ram head 26 pushes weapon 16 out of launch tube 18.

Figure 6:
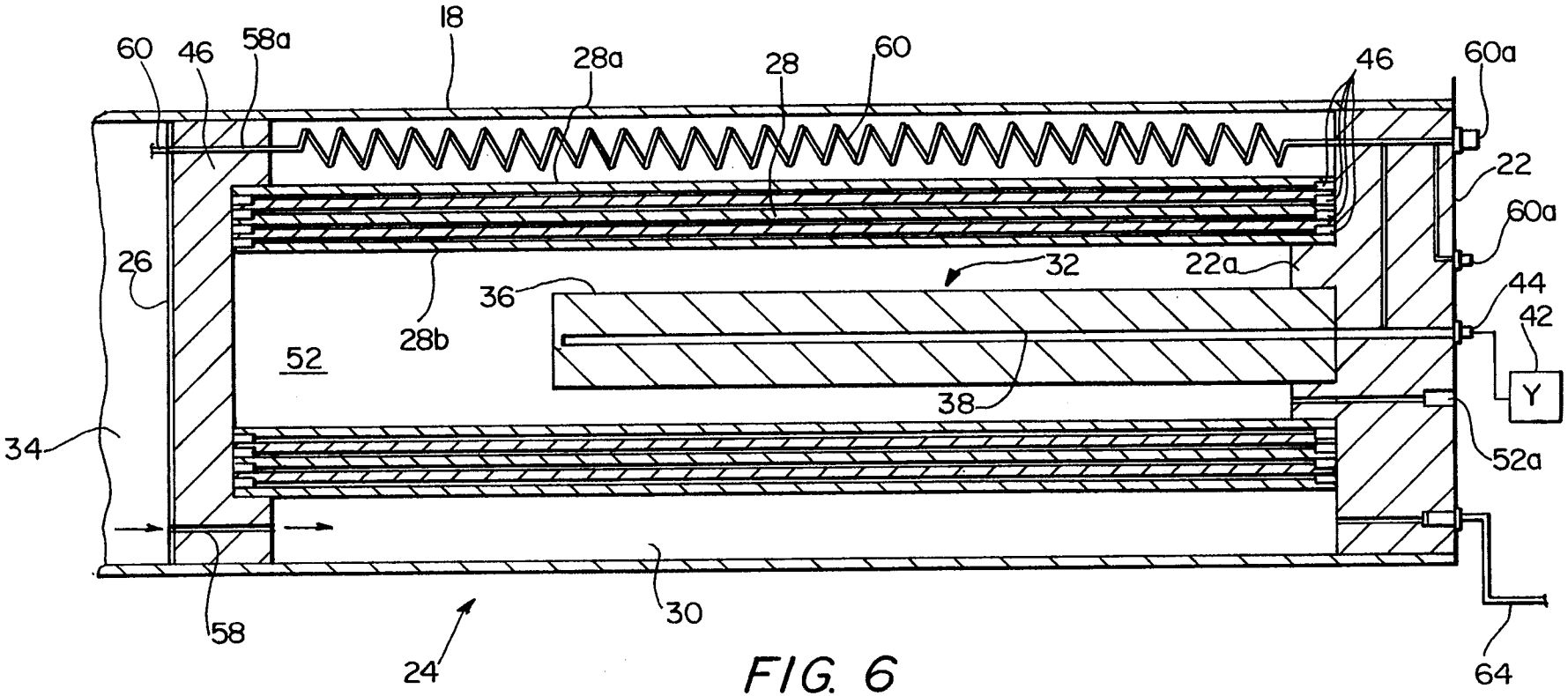
FIG. 6 is a detailed cross-sectional view of the ram assembly of the present invention as used in the embodiment of FIG. 4 and as used in the embodiment of FIG. 1 with the fairing omitted for clarity.

Referring to FIG. 6, ejecting means 32 is preferably contained entirely within telescoping cylinders 28 and comprises a gas generator 36, such as a cylinder of solid propellant, an igniter 38, and a voltage supply 42 connected to the igniter by an external connector 44. When the weapon is to be launched, voltage is supplied from voltage supply 42 to the igniter 38 via connector 44, whereupon gas generator 36 ignites and starts generating gas. The expanding gas pushes against ram head 26, thereby ejecting weapon 16 and actuating the telescoping cylinders 28.

Again referring to FIG. 6, ram assembly 24 further includes a sealing and retention means 46 to seal each of the telescoping cylinders 28 to one another and retain the cylinders in telescoped relationship. The outermost telescoping cylinder **28*a* is rigidly attached and sealed by conventional means to ram head 26. One of the telescoping cylinders 28, preferably the innermost telescoping cylinder 28*b*, is appropriately attached and sealed by conventional means to launcher base 22 at the periphery of a raised boss 22*a*. It can thus be seen that the telescoping cylinders 28, launcher base 22, and ram head 26 form a completely sealed, gas-tight volume 52 which may be pressurized as required via port 52*a*. The gas generated by gas generator 36 is entirely contained within volume 52 during the entire launch sequence. Gas cannot escape this volume, and thus the launch of the weapon cannot be detected by escaping launch gas, unlike the prior art launch systems where large telltale, launch gas bubbles are often produced. Some of the gas in the space in weapons bay 29 not occupied by weapon 16 will escape upon launch but much less than in the prior art. Even this may be minimized by filling the otherwise empty space in the weapons bay 29** with a material which falls away as the weapon is launched and sinks or dissolves in the ocean water.

Figure 3:
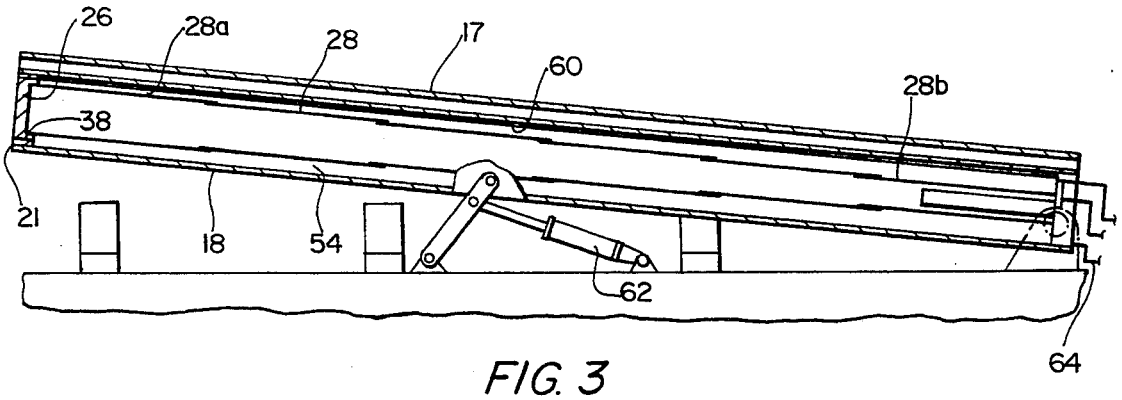
FIG. 3 is a cross-sectional side view of the launch system of FIGS. 1 and 2 subsequent to weapon launch.

Referring to FIG. 3, the weapons launch system 15 is shown wherein the weapon 16 is launched and telescoping cylinders 28 are in their extended position. Ram assembly bay 30 now extends the entire length of tube 18. To compensate for the weight of the expended weapon without using ballast or other conventional methods, it is preferred that a plurality of ports 58 in ram head 26 be provided through which water can be received within ram assembly bay 30. The volume of ram assembly bay 30 is sized so that the weight of the water received therein is approximately equal to the weight of the expended weapon. Thus, the overall weight of the weapons launch system is the same both before and after the weapon is launched. Ports 58 preferably extend around the periphery of ram head 26. Thus, when ram assembly 24 is fully actuated and ram head 26 is located at the exterior of tube 18, water enters ram assembly bay 30 through the plurality of ports 58. As water enters ram assembly bay 30, the gas that was in it will escape through ports 58. Here again, the amount of gas that escapes will be much less than if the entire tube were allowed to fill. Additionally, ports 58 permit the pressures of weapon bay 29 and ram assembly bay 30 to be equalized before and during launch.

The weapon is provided with targeting information as appropriate by means of a targeting wire assembly 60 which extends from launcher base 22, through the ram assembly bay 30, and through one of the ram head ports 58*a* to the weapon 16. Communication between wire assembly 60 and the weapons control system is provided via connectors 60*a*. The wire assembly is released from the weapon upon launch.

Operation of the weapons launch system is as follows. The weapon is first programmed with the appropriate targeting information via targeting wire assembly 60, and the system is verified in a conventional manner. Latching means 21 is disengaged, and launch is initiated by applying an appropriate voltage to igniter 38, whereupon the gas generator 36 ignites and starts generating gas which expands to eject the weapon and simultaneously to initiate a telescopic lengthening of ram assembly 24. Gas generator 36 may preferably be of the unchoked type; this would produce much less noise than the choked type used in other weapons launch systems. Preferably, ram assembly 24 provides a launch acceleration rate in the range of one to five g's or as required by the weapon. This acceleration is imparted to the weapon by ram head 26. As weapon 16 begins to move, end cap 20 is dislocated from the head of weapon 16 and is jettisoned. Upon full extension of the ram assembly 24, the weapon 16 is completely ejected from the tube. Full extension of the ram assembly 24 places ram head 26 at the same location as the initial position of the end cap 20, and ram head 26 is captured and held in place by latching means 21. Since ram head 26 now contacts the water external to the vessel, the ports 58 allow the passage of external water into ram assembly bay 30, whereupon the weight of the weapon is compensated by the weight of the external water received within ram assembly bay 30.

In the embodiment of FIGS. 1 through 3, the weapons launch system is mounted externally to the submarine hull. In this externally mounted embodiment, a lift means 62 is preferably provided for lifting the system between a horizontal, stowed position (as shown in FIG. 2) and an angled, launch position (as shown in FIG. 3). Thus, the optimal launch angle can be provided for the weapons launch system.

It may be necessary at the time of launch that the pressure in weapons bay 29 and ram assembly bay 30, which are connected by ports 58 be the same as ambient water pressure. This would prevent damage to the weapon 16 due to any difference in pressure between the weapon and the ambient water pressure when it is launched. This is accomplished by introducing compressed gas through gas pressurizing port 64.

Figure 4:
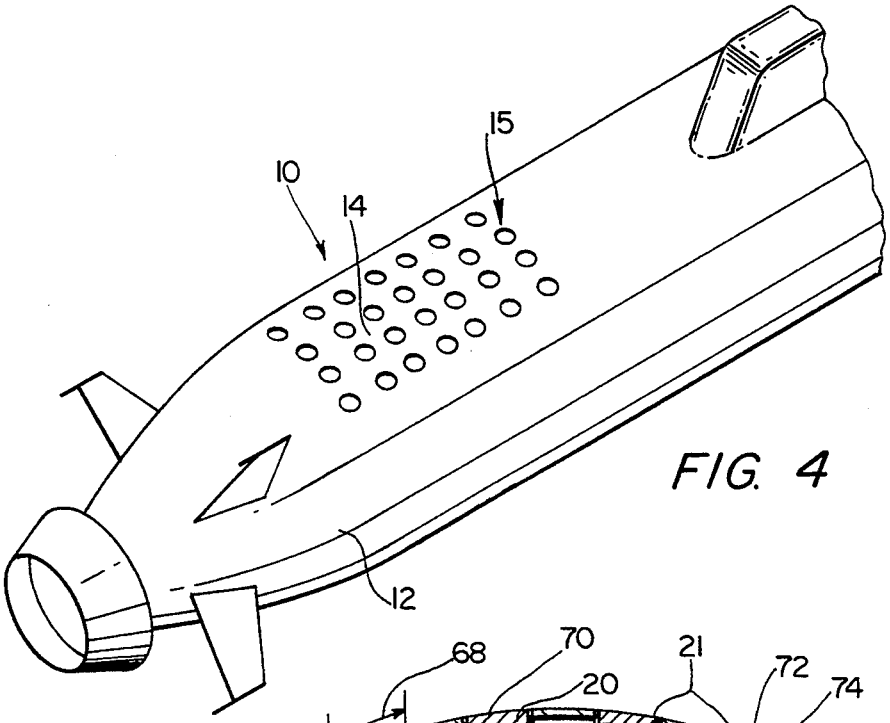
FIG. 4 is a partial perspective view of a submarine with a second embodiment of the launch system of the present invention.
Figure 5:
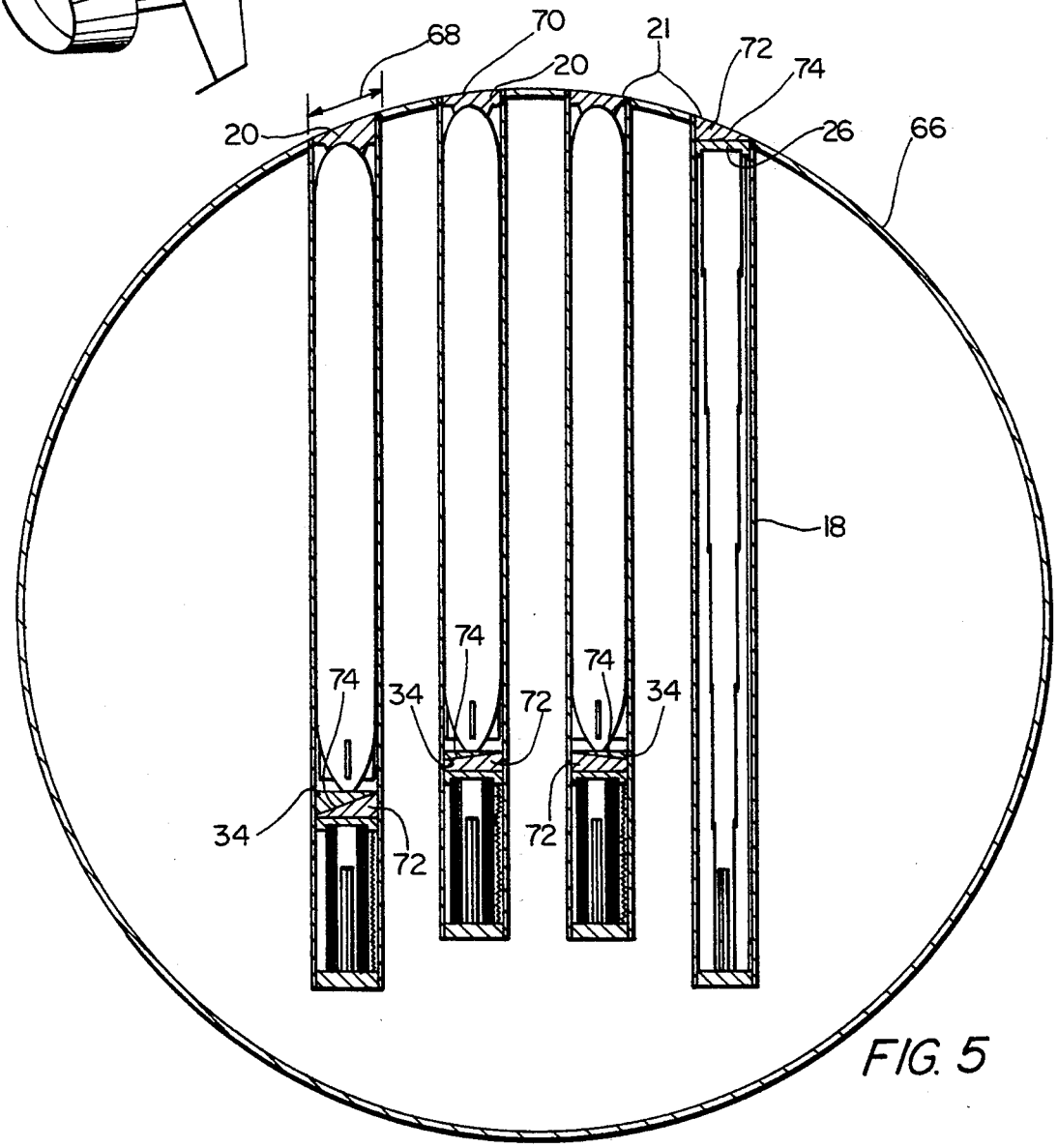
FIG. 5 is a cross-sectional view of the launch system of FIG. 4.

Alternative to the external configuration, the weapons launch system can be mounted internally, as shown in FIGS. 4 and 5, in a similar manner as the conventional vertical weapons launch systems currently in use. Preferably, the internal weapons launch system is disposed with the launch tube vertical, as is shown in FIG. 5. Referring again to FIG. 2, in the externally mounted embodiment, the shape of end cap 20 is of no particular consequence; hence, a flat end cap is the most economical and preferred configuration. However, in the internally mounted embodiment of FIG. 4, the shape of the end cap is important. As seen in FIG. 4, the submarine includes an external contoured surface 66. Because the launch tube 18 creates a gap 68 in the vessel contoured surface 66, it is preferable for end cap 20 to include an outer surface 70 complementary to vessel contoured surface 66 such that prior to weapon launch, there is no significant disruption in the contoured surface.

After the weapon is launched and the disposable end cap 20 has been jettisoned, gap 68 would once again be exposed. To replace end cap 20 and maintain continuity of surface 66, disposable filler block 34 is supplemented with a fairing block 72. Fairing block 72 may be secured to ram head 26, or, alternatively, may be integral with ram head 26. When the weapon is launched and the ram assembly is actuated, disposable filler block 34 is jettisoned and fairing block 72 is captured within the launch tube opening by latching means 21. Fairing block 72 includes an outer surface 74 complementary to vessel contoured surface 66 and outer surface 70 of end cap 20 so that after the weapon is launched, the contour of vessel surface 66 is maintained.

Preferably, tube 18 will be designed so that the internal diameter thereof is appropriate to the weapon being launched, and the length thereof is appropriate to the weapon being launched and the required launch mechanism. It thus can be seen that weapons of any size can be accommodated by the launch system of the present invention. Furthermore, the wall thickness and material of the tube are appropriate to the pressures and conditions of the environment in which the launch system is to be utilized.

It should also be noted that the launch system of the present invention in its external embodiment permits weapons to be positioned for aft firing. Additionally, the external embodiment frees a significant amount of the vessel internal space, previously used for receiving conventional launch systems. Thus, it is possible to use smaller and more inexpensive submarines without compromising the weapons capacity. Moreover, because the external launch system is neutrally buoyant, the weight of the launch system is irrelevant, and the number of weapons that can be carried aboard is limited solely by the space available for external weapon stowage and by stability considerations.

Launch noise signature for the launch system is negligible and is primarily composed of sounds from the sliding fit between the outer diameter of ram head 26 and the inner diameter of tube 18. Combustion of the unchoked gas generator does not contribute significantly to the launch noise signature.

From the foregoing detailed description, it will be evident that there are a number of changes, adaptations and modifications of the present invention which come within the province of those having ordinary skill in the art. However, it is intended that all such variations not departing from the spirit of the invention be considered as within the scope thereof, limited solely by the appended claims.

I claim:

1. A system for launching a weapon from a submersible vessel, comprising:

a tube for receiving said weapon;

a ram assembly for launching said weapon, said ram assembly including a ram head for transmitting a launching force to said weapon and a plurality of telescoping cylinders positioned within said tube, said telescoping cylinders extending within said tube when said weapon is launched;

an ejection means within said ram assembly generating said launching force to extend said telescoping cylinders;

a volume formed between said tube and said telescoping cylinders in their extended position; and access means for receiving water within said volume after said weapon is launched.

2. A system according to claim 1, wherein said weapon has a predetermined weight and said volume is sized such that the weight of said water received within said volume is approximately equal to the weight of said weapon.

3. A system according to claim 1, wherein said ejection means is located within said telescoping cylinders.

4. A system according to claim 1, wherein said ejection means comprises a means for generating pressurized gas.

5. A system according to claim 4, wherein said means for generating pressurized gas includes a propellant and a means for igniting said propellant.

6. A system according to claim 5, wherein said igniting means includes an igniter and means for supplying a voltage to said igniter.

7. A system according to claim 1, further comprising sealing and retention means between said plurality of telescoping cylinders.

8. A system according to claim 1, wherein one of said plurality of telescoping cylinders is attached to said ram head, and wherein said system further comprises means for fixing said one of said plurality of telescoping cylinders in sealing engagement with said ram head.

9. A system according to claim 1, wherein one of said plurality of telescoping cylinders is attached to said ram head and said ejecting means is disposed within said telescoping cylinders and includes a base to which one of said telescoping cylinders is attached in sealing relationship, said system further comprising:

sealing means between said plurality of telescoping cylinders and between said one of said plurality of telescoping cylinders and said ram head; and a gas-tight volume formed by said telescoping cylinders, said ram head and said ejecting means base.

10. A system according to claim 9, wherein said gas-tight volume reduces the emission of bubbles from said ejecting means.

11. A system according to claim 1, wherein said ram head includes a plurality of ports, said access means comprising said plurality of ports.

12. A system according to claim 1, further comprising a disposable end cap for sealing an external end of said tube.

13. A system according to claim 12, further comprising latching means for releasably securing said end cap in said tube.

14. A system according to claim 12, further comprising means for sealing said end cap to said tube.

15. A system according to claim 14, wherein said end cap sealing means includes at least an O-ring.

16. A system according to claim 1, wherein said system is mounted externally to said submersible vessel.

17. A system according to claim 16, further comprising means for lifting said tube from a horizontal, stowed position to an angled, firing position.

18. A system according to claim 16, further comprising means for pressurizing said tube at a pressure substantially equal to environmental pressure.

19. A system according to claim 18, wherein said pressurizing means includes means for introducing compressed air into the tube.

20. A system according to claim 1, wherein said system is internally located within said submersible vessel.

21. A system according to claim 20, wherein said tube is vertically disposed within said submersible vessel.

22. A system according to claim 20, wherein said submersible vessel includes an external contoured surface, said system further comprising a disposable end cap for sealing the end of the tube, the disposable end cap including an outer surface complementary to the vessel contoured surface.

23. A system according to claim 22, further comprising latching means for releasably securing said end cap in said tube.

24. A system according to claim 22, further comprising means for sealing said end cap to said tube.

25. A system according to claim 24, wherein said end cap sealing means includes at least an O-ring.

26. A system according to claim 22, further comprising a fairing block abutting said ram head and a disposable filler block abutting said fairing block and contacting said weapon, said fairing block including an outer surface which duplicates said outer surface of said disposable end cap.

27. A system according to claim 26, wherein said fairing block is secured to said ram head.

28. A system according to claim 26, wherein said fairing block is integral with said ram head.

29. A system according to claim 26, further comprising latching means for releasably securing said end cap and said fairing block in said tube.

30. A system according to claim 20, further comprising a fairing block abutting said ram head and a disposable filler block abutting said fairing block and contacting said weapon, and wherein said water vessel has an external contoured surface, said fairing block including an outer surface complementary to the vessel contoured surface.

31. A system according to claim 30, wherein said fairing block is secured to said ram head.

32. A system according to claim 30, wherein said fairing block is integral with said ram head.

33. A system according to claim 30, further comprising latching means for releasably securing said fairing block in said tube.

34. A system according to claim 1, further comprising:

a disposable end cap at one end of said tube for sealing the end of said tube;

a launcher base at an opposite end of said tube to which said ejection means is attached;

a weapon bay formed by said disposable end cap, said tube, and said ram head, said weapon bay having a pressure;

and a ram assembly bay formed by said ram head, said tube, and said launcher base, said ram assembly bay having a pressure; and means for equalizing said weapon bay pressure and said ram assembly bay pressure.

35. A system according to claim 34, wherein said ram head includes a plurality of ports, said equalizing means comprising said plurality of ports.

36. A system for launching a weapon from a water vessel, comprising:

a tube for receiving said weapon;

a ram assembly for launching said weapon, said ram assembly including a ram head for providing a force to said weapon and a plurality of telescoping cylinders positioned within said tube, said telescoping cylinders extending within said tube when said weapon is launched; and a means for ejecting said weapon from said tube thereby extending said telescoping cylinders, said ejecting means comprising a propellant and a means for igniting the propellant, the propellant being contained within said telescoping cylinders.

37. A system according to claim 36, wherein said ejecting means includes an igniter and means for supplying a voltage to said igniter.

38. A system according to claim 36, wherein one of said plurality of telescoping cylinders is attached to said ram head and said ejecting means includes a base to which another of said telescoping cylinders is attached in sealing relationship, said system further comprising:

sealing means between said plurality of telescoping cylinders and between said one of said plurality of telescoping cylinders and said ram head; and a gas-tight volume formed by said telescoping cylinders, said ram head and said ejecting means base.

39. A system according to claim 38, wherein said gas-tight volume reduces the emission of bubbles from said ejecting means.

40. A system according to claim 36, further comprising:

a disposable end cap at one end of said tube for sealing the end of said tube;

a launcher base at an opposite end of said tube to which said ejecting means is attached;

a weapon bay formed by said disposable end cap, said tube, and said ram head, said weapon bay having a pressure;

and a ram assembly bay formed by said ram head, said tube, and said launcher base, said ram assembly bay having a pressure; and means for equalizing said weapon bay pressure and said ram assembly bay pressure.

41. A system for launching a weapon from a water vessel, comprising:

a tube for receiving said weapon, said tube being mounted externally to said water vessel, a ram assembly for launching said weapon, said ram assembly including a ram head for transmitting a launching force to said weapon and a plurality of telescoping cylinders positioned within said tube, said telescoping cylinders extending within said tube when said weapon is launched;

an ejection means within said ram assembly for generating said launching force to extend said telescoping cylinders; and a means for pressurizing said tube at a pressure substantially equal to environmental pressure.

42. A system according to claim 41, wherein said pressurizing means includes means for introducing compressed air into the tube.

43. A system according to claim 41, further comprising means for lifting said tube from a horizontal, stowed position to an angled firing position.

44. A system for launching a weapon from a water vessel, said water vessel including an external surface, said system comprising:

a tube for receiving said weapon, said tube being internally located within said vessel;

a ram assembly for launching said weapon, said ram assembly including a ram head for transmitting a launching force to said weapon and a plurality of telescoping cylinders positioned within said tube, said telescoping cylinders extending within said tube when said weapon is launched;

an ejection means within said ram assembly for generating said launching force to extend said telescoping cylinders; and a fairing block abutting said ram head, said fairing block including an outer surface complementary to said water vessel external surface.

45. A system according to claim 44, further comprising a disposable filler block abutting said fairing block and contacting said weapon.

46. A system according to claim 44, wherein said tube is vertically disposed within said water vessel.

47. A system according to claim 44, further comprising latching means for releasably securing said fairing block in said tube.

48. A system according to claim 44, further comprising a disposable end cap for sealing the end of the tube, the disposable end cap including an outer surface complementary to the outer surface of said vessel external surface.

49. A system according to claim 44, wherein said fairing block is secured to said ram head.

50. A system according to claim 44, wherein said fairing block is integral with said ram head.

* * * * *